US012465181B1

(12) United States Patent
Henig

(10) Patent No.: US 12,465,181 B1
(45) Date of Patent: Nov. 11, 2025

(54) ROLLED SHEET DISPENSING DEVICE WITH BRAKING MECHANISM

(71) Applicant: Frederick George Henig, Oldsmar, FL (US)

(72) Inventor: Frederick George Henig, Oldsmar, FL (US)

( * ) Notice: Subject to any disclaimer, the term of this patent is extended or adjusted under 35 U.S.C. 154(b) by 364 days.

(21) Appl. No.: 18/135,881

(22) Filed: Apr. 18, 2023

Related U.S. Application Data

(60) Provisional application No. 63/332,036, filed on Apr. 18, 2022.

(51) Int. Cl.
*A47K 10/36* (2006.01)

(52) U.S. Cl.
CPC ..... *A47K 10/36* (2013.01); *A47K 2010/3675* (2013.01)

(58) Field of Classification Search
CPC ..... A47K 10/36
See application file for complete search history.

(56) References Cited

U.S. PATENT DOCUMENTS 5,135,179 A * 8/1992 Morano ..... A47K 10/3836 242/565
5,988,561 A * 11/1999 Mele ..... A47K 10/40 242/599.3
6,439,501 B1 * 8/2002 Harmathy ..... A47K 10/38 242/596.7
2002/0070308 A1 * 6/2002 Fahringer ..... A47K 10/38 242/423.2
2006/0071119 A1 * 4/2006 Zeitlin ..... B65H 16/005 242/598.3
2011/0233255 A1 * 9/2011 Tiamson ..... A47K 10/3836 225/77
2013/0043266 A1 * 2/2013 Hagleitner ..... A47K 10/36 221/26
2014/0339281 A1 * 11/2014 Flocchini ..... A47K 10/3836 225/106
2018/0029816 A1 * 2/2018 Cain ..... A47K 10/22
2022/0386828 A1 * 12/2022 Hecker ..... A47K 10/34

* cited by examiner

*Primary Examiner* — Gene O Crawford
*Assistant Examiner* — Ayodeji T Ojofeitimi
(74) *Attorney, Agent, or Firm* — Andrew Behrens; Michele Lawson; Smith & Hopen, P.A.

(57) ABSTRACT

A novel rolled material dispensing device is presented. The novel paper towel holder is for use on a flat surface and is generally comprised of a base, a solid rod attached to the base, a removeable cover attached to the proximal end of the rod, and a braking mechanism fixedly attached to the cover or rod. Depressing the cover engages braking mechanism and moves the cover to be in contact with the rolled material thus stopping movement of the rolled material and allowing the user to remove a user determined amount of the rolled material while keeping the remaining material dry and uncontaminated.

20 Claims, 7 Drawing Sheets

ROLLED SHEET DISPENSING DEVICE WITH BRAKING MECHANISM

CROSS REFERENCE TO RELATED APPLICATIONS

This application is a nonprovisional of and claims priority to U.S. Provisional Patent Application No. 63/332,036, entitled "Rolled Sheet Dispensing Device with Braking Mechanism", filed Apr. 18, 2022, the entire contents of which is herein incorporated into this disclosure.

FIELD OF INVENTION

This invention relates to devices capable of storing and dispensing rolled materials. Specifically, the invention provides a novel dispenser device for rolled materials having a cover with a braking mechanism to allow for easy removal of a user determined amount of material.

BACKGROUND OF THE INVENTION

Dispensing devices for rolled materials, such as paper towels, are well known in the art. Countertop devices are generally comprised of a base having a rod extending upwardly therefrom. The rolled materials are generally rolled around a hollow cylinder with the hollow center telescopingly receiving the rod when the rolled materials are positioned in the device. In order to separate the rolled material along the serrated lines, a user must touch the remaining rolled material thus making the remaining rolled material wet or dirty. Alternatively, the user must use a flicking motion of the wrist to attempt to tear the rolled material along the serrated lines, however this often results in undesirous additional rolled material being unwound from the roll which must either be discarded or rewound onto the roll, causing further contamination.

In light of the shortcomings of the prior art, the inventor has developed a rolled material dispensing device capable of keeping the remaining rolled material dry and uncontaminated while still allowing for precise removal of a desired amount of the rolled sheet material.

SUMMARY OF INVENTION

The inventor has developed a novel rolled material storage and dispensing device having a solid top cover with a braking mechanism. The braking mechanism of the device allows for a user to easily dispense the needed amount of rolled material without having to come into contact with the remaining rolled material thus contaminating or moistening the remaining rolled material and without unspooling an unwanted amount of material.

The dispensing device generally comprises a base having a rod fixedly attached. The rod may be substantially solid except for a cavity positioned at the proximal end of rod. Cavity is sized to accommodate braking mechanism or a combination of braking mechanism and cylinder. A removeable cover is provided with a cylinder extending from bottom surface. The cover has a diameter that is greater than the diameter of the rolled materials to protect the rolled materials from moisture or contamination when in use. Braking mechanism may be attached to cover (and contained within cylinder) or attached to cylinder itself or alternatively may be attached to bottom of cavity. When cover is positioned on dispensing device and depressed, braking mechanism is engaged and cover moves to be in contact with rolled sheet material thus preventing further movement of rolled sheet material and allowing user to dispense desired amount of rolled sheet material.

In an embodiment, a rolled material dispensing device is presented comprising: a base having a rod extending perpendicularly therefrom; a cavity formed in a proximal end of the rod; a cover having a top and a bottom surface and removably attached to the proximal end of the rod wherein the cover has a diameter greater than the diameter of the rolled material; and a braking mechanism fixedly attached to the bottom surface of the cover wherein the braking mechanism extends into the cavity formed in the proximal end of the rod when the cover is attached to the rod. The braking mechanism may comprise a biasing member which is a spring in some embodiments.

The device may be further comprised of a hollow cylinder, having a diameter greater than a diameter of the rod, and fixedly attached to a bottom surface of the cover. The braking mechanism may be positioned within the hollow cylinder.

The diameter of the rod is less than a diameter of a core of a rolled material enabling the rod to be telescopingly inserted into the core of the rolled material for dispensing. The rod may be substantially solid. The device may be further comprised of a handle fixedly attached to the top surface of the cover.

In another embodiment, a rolled material dispensing device is presented comprising: a base having a rod extending perpendicularly therefrom; a cavity formed in a proximal end of the rod; a cover having a top and a bottom surface and removably attached to the proximal end of the rod wherein the cover has a diameter greater than the diameter of the rolled material; a solid cylinder extending distally from the bottom surface of the cover; and a braking mechanism fixedly attached to a distal end of the cylinder wherein the braking mechanism and the cylinder extend into the cavity formed in the proximal end of the rod when the cover is attached to the rod. The braking mechanism may comprise a biasing member which is a spring in some embodiments. The device may be further comprised of a handle fixedly attached to the top surface of the cover.

The diameter of the rod may be less than a diameter of a core of a rolled material enabling the rod to be telescopingly inserted into the core of the rolled material for dispensing. The rod may be substantially solid.

In a further embodiment, a method of dispensing rolled material is provided comprising: providing a rolled material dispensing device comprising a base having a rod extending perpendicularly therefrom; a cavity formed in a proximal end of the rod; a cover having a top and a bottom surface and removably attached to the proximal end of the rod wherein the cover has a diameter greater than the diameter of the rolled material; a solid cylinder extending distally from the bottom surface of the cover; and a braking mechanism fixedly attached to a distal end of the cylinder wherein the braking mechanism and the cylinder extend into the cavity formed in the proximal end of the rod when the cover is attached to the rod; pulling the rolled material to dispense a desired amount; exerting a downward force on the cover until the bottom surface of the cover engages with a surface of the rolled material to stop movement of the rolled material; removing the desired amount of the rolled material; and removing the downward force from the cover to allow cover to disengage with the surface of the rolled material.

The braking mechanism may comprise a biasing member which is a spring in some embodiments. The device may be further comprised of a handle fixedly attached to the top surface of the cover.

The diameter of the rod may be less than a diameter of a core of a rolled material enabling the rod to be telescopingly inserted into the core of the rolled material for dispensing. The rod may be substantially solid.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
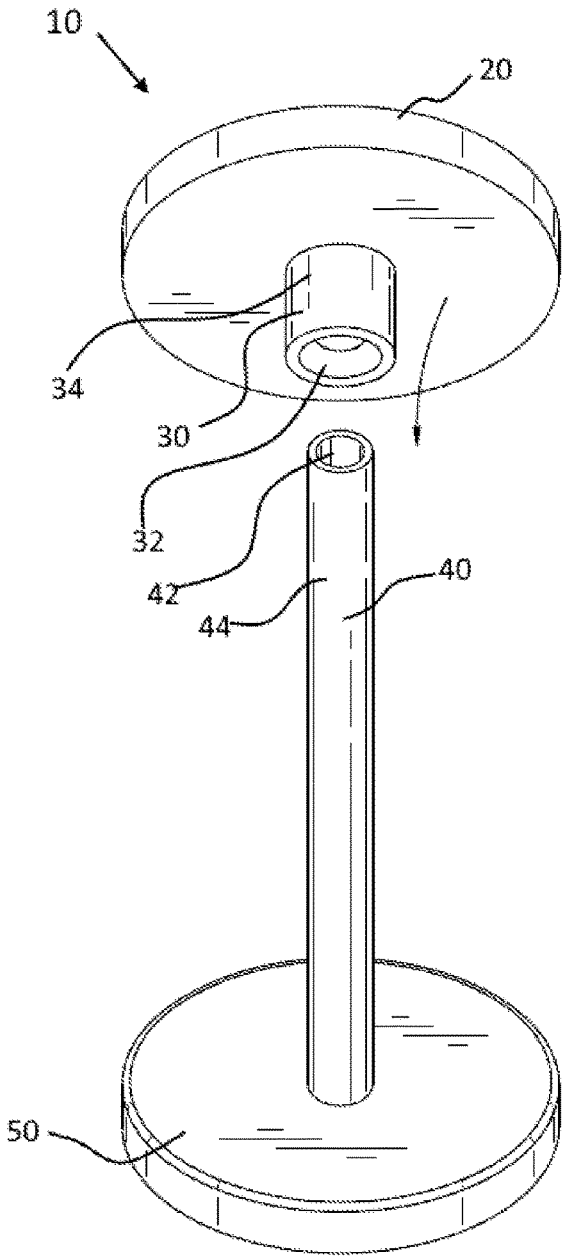
FIG. 1 is a perspective view of an embodiment of the device showing the cover removed.

In the following detailed description of the preferred embodiments, reference is made to the accompanying drawings, which form a part hereof, and within which are shown by way of illustration specific embodiments by which the invention may be practiced. It is to be understood that other embodiments may be utilized, and structural changes may be made without departing from the scope of the invention. The following description is not intended to limit the scope of the present description disclosed herein.

All numerical designations, including ranges, are approximations which are varied up or down by increments of 1.0 or 0.1, as appropriate. It is to be understood, even if it is not always explicitly stated that all numerical designations are preceded by the term "about". It is also to be understood, even if it is not always explicitly stated, that the reagents described herein are merely exemplary and that equivalents of such are known in the art and can be substituted for the reagents explicitly stated herein.

The term "about" or "approximately" as used herein refers to being within an acceptable error range for the particular value as determined by one of ordinary skill in the art, which will depend in part on how the value is measured or determined. As used herein, the term "about" refers to +10%.

The term "substantially" as used herein refers to an amount that is greater than 50% up to and including 100%. For example, a "substantially hollow rod" means that more than 50% of the rod is hollow up to 99% of the rod being hollow.

The term "slightly" as used herein refers to a small degree. The degree of the term "slightly" can be determined by the context of use. For example, a rod having a diameter that is slightly less than the diameter of a cylinder means that the diameter of the rod must be sufficiently smaller than the diameter of the cylinder such that rod can be positioned within the cylinder.

As used herein, the term "comprising" is intended to mean that the products and methods include the referenced components or steps, but not excluding others. "Consisting essentially of" when used to define products and methods, shall mean excluding other components or steps of any essential significance. "Consisting of" shall mean excluding any other components or steps.

As used in the specification and claims, the singular form "a", "an" and "the" include plural references unless the context clearly dictates otherwise.

"Rolled material" or "rolled sheet product" as used herein refers to any material supplied in a continuous roll on a hollow cylinder or core for distribution. In some embodiments, the rolled materials are in the form of continuous sheets that are separated by perforations to allow removal of a given portion of the rolled materials. Exemplary rolled materials include, but are not limited to, paper products such as paper towels and toilet paper, printed material, packaging material, foils, wrapping paper, wax paper, plastic bags, plastic sheets, and laminate.

The term "diameter" as used herein refers to a straight line passing through the center of a circle or sphere and meeting the circumference or surface at each end. While the examples describe circular shapes and thus use the term "diameter", other shapes are contemplated, particularly for the cover and base, for example. As such, use of the term "diameter" is not to be construed as limiting to a circular shape. The term "diameter" is used interchangeably with the term "width" herein, particularly in the context of shapes that are not circular. The width of a shape that is not a circle is the distance measured from side to side.

To address the shortcomings of the prior art, the inventors have developed a dispensing device which allows a user to dispense the desired amount of the rolled material without contaminating or dampening the remaining rolled material. A user does not need to hold the roll itself to brake the roll when dispensing the rolled material, thus dampening or contaminating the roll. As such, the device offers a cleaner, safer, and more hygienic device than what is presently available. This novel device also has the advantage of dispensing the desired amount of material without unwinding the remaining material from the roll. The device minimizes the amount of waste since a predetermined amount of rolled material may be easily dispensed. The device may be fabricated from many varied materials and be sized to accommodate many sizes of rolled sheet materials.

The invention is described below as an embodiment for a paper sheet dispenser for use with rolled paper sheet materials having a hollow core, such as paper towels, however the invention is not intended to be limited to a dispenser for dispensing a particular type of rolled material as it will be obvious to one of skill in the art that other types of household and industrial materials in roll form may be dispensed by the novel device described herein, including, but not limited to, paper products, printed material, packaging material, foils, wrapping paper, wax paper, plastic bags, plastic sheets, laminate, and any other materials provided in roll form. In the embodiment described herein, individual portions which form the roll are separated by serrated lines or perforations.

Other features, advantages, and objects of the present invention will become apparent with reference to the following description and accompanying drawings. With these and other objects definitely in view, this invention consists in the novel construction, combination and arrangement of elements and portions, as will be hereinafter fully described in the specification, particularly pointed out in the claims, and illustrated in the drawings which form a material part of this disclosure and wherein similar characters of reference indicate similar or identical elements and portions throughout the specification and throughout the views of the drawing.

Generally, rolled material dispenser 10 is comprised, from proximal to distal end, of cover 20 having cylinder extending distally from bottom surface of cover 20. Cylinder 30 may be hollow or solid in construction depending on the embodiment as described in more detail below. Cylinder 30 is sized to either receive (hollow/female orientation) or be received (solid or male orientation) by rod 40 thus engaging cylinder with proximal end of rod 40 to attach cylinder 30 to rod 40. Distal end of rod 40 is fixedly attached to base 50. With reference to FIGS. 1-10, preferred embodiments of the invention are described which embody the principles and concepts of the present invention.

FIG. 1 displays one embodiment of rolled material dispenser 10 in which cylinder 30 attached to cover 20 has a hollow core (female orientation) such that cylinder 30 has inner 32 and outer 34 circumferential surfaces. As shown in the image, cylinder 30 extends distally from bottom surface of cover 20. Cylinder 30 is fixedly attached to and positioned on cover 20 such that cylinder 30 is capable of engagement with proximal end of rod 40 when in use. In some embodiments, cylinder 30 is positioned in center of cover 20. Cylinder 30 is sized so as to receive proximal end of rod 40 when device is fully assembled.

In this embodiment, rod 40, having inner 42 and outer 44 circumferential surfaces, must have a diameter slightly smaller than inner diameter of cylinder 30 to allow a proximal section of rod 40 to be inserted into cylinder 30. In some embodiments, outer circumferential surface 44 of rod 40 is in contact with inner circumferential surface 32 of cylinder 30 when in use. As discussed in more detail in later figures, proximal end of rod 40 contains cavity 46 which is sized to receive braking mechanism 70. Inner circumferential surface of cavity 46 defines inner circumferential surface 42 of rod 40, meaning that the two are the same. The diameter of rod 40 is less than the diameter of core of rolled material to allow rolled material to be telescopingly inserted onto rod 40. In an embodiment, rod 40 may be of sufficient length to receive a rolled material being telescopingly inserted thereon such that a portion of the proximal end of rod 40 protrudes outwardly from proximal end of core of rolled material. Alternatively, the height of rod 40 may be slightly less than the height of rolled material. In either embodiment, diameter of cylinder 30 is slightly smaller than diameter of core of rolled sheet to allow cylinder 30 to enter core of rolled material when cover 20 is depressed. Distal end of rod 40 is fixedly attached to base 50 to prevent movement of rod 40 from base 50. Alternatively, rod 40 and base 50 may be formed as one continuous unit. Rod 40 may be substantially solid, except for cavity 46 or alternatively, rod 40 may be substantially hollow. Base 50 is depicted as circular, however other shapes are contemplated in a size greater than diameter of rolled material to be capable of supporting rolled material.

Cover 20 is depicted as a circular, however, similar to base 50, other shapes are contemplated, provided the diameter/width is greater than the diameter of the rolled material. Cover 20 is removably attached to proximal end of rod 40. In some embodiments, bottom surface of cover 20 may have gripping means to more easily contact rolled material when braking mechanism 70 is engaged. Such gripping means may provide a texturized surface and may include, but are not limited to, a rubberized polymer. Cover 20 is sized to be larger in diameter than the diameter of rolled material so that cover 20 can protect rolled sheet material from contamination and moisture when in use.

Figure 2:
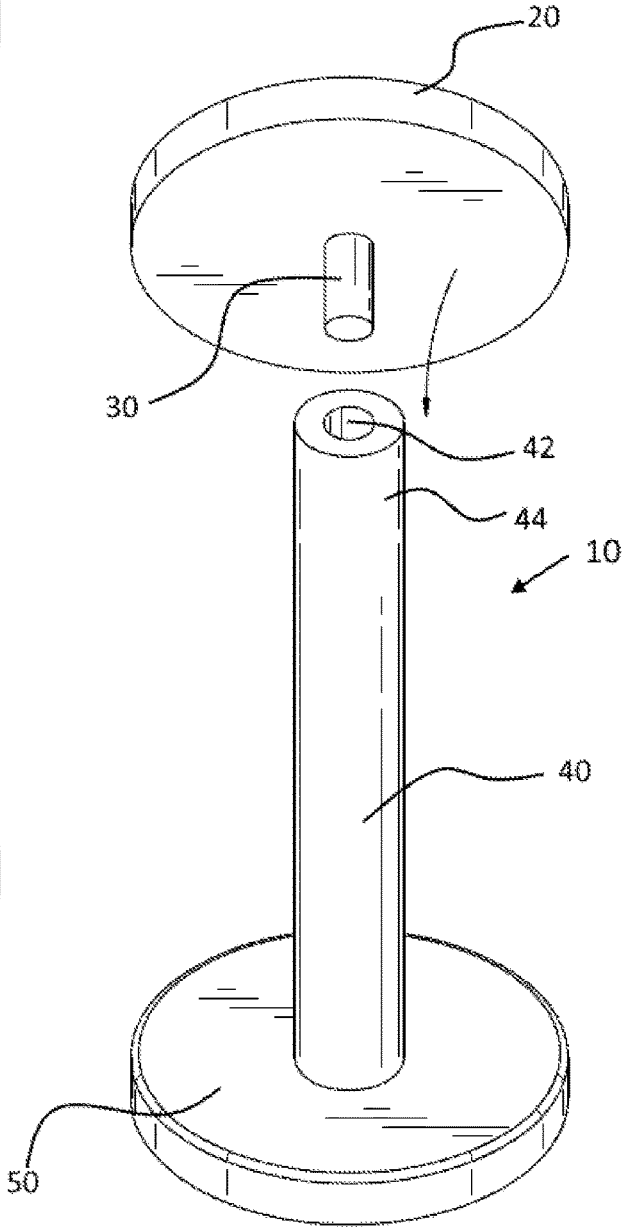
FIG. 2 is a perspective view of an embodiment of the device showing the cover removed.

FIG. 2 depicts an alternative embodiment in which cylinder 30 attached to cover 20 is solid (male orientation). In this embodiment, cylinder 30 is of a slightly smaller diameter than the diameter of inner circumferential surface 42 of rod 40 so as to allow for insertion of cylinder 30 into proximal end of rod 40. In this embodiment, the diameter of rod 40 is greater than the diameter of cylinder 30, however the diameter of rod 40 is less than the diameter of core of rolled material to allow rolled material to be telescopingly inserted onto rod 40. Rod 40 may be of sufficient length to receive a rolled material being telescopingly inserted thereon such that a portion of the proximal end of rod 40 protrudes outwardly from proximal end of core of rolled material. Alternatively, height of rod 40 may be slightly less than the height of rolled material. In either embodiment, diameter of cylinder 30 is less than diameter of rod 40 to allow cylinder 30 to be inserted into proximal end of rod 40 when cover 20 is depressed. Distal end of rod 40 is fixedly attached to base 50 to prevent movement of rod 40 from base 50. Alternatively, rod 40 and base 50 may be formed as one continuous unit. Rod 40 may be substantially solid, except for cavity 46 or alternatively, rod 40 may be substantially hollow. Base 50 is depicted as circular, however other shapes are contemplated in a size greater than diameter of rolled material to be capable of supporting rolled material.

Similarly, cover 20 is depicted as circular, however other shapes are contemplated. In some embodiments, bottom surface of cover 20 may have gripping means to more easily contact rolled sheet material when braking mechanism 70 is engaged. Such gripping means include, but are not limited to, a rubberized polymer. As noted with FIG. 1, cover 20 is sized to be larger in diameter/width than the diameter of rolled sheet material so that cover 20 can protect rolled sheet material from contamination and moisture when in use.

Figure 3:
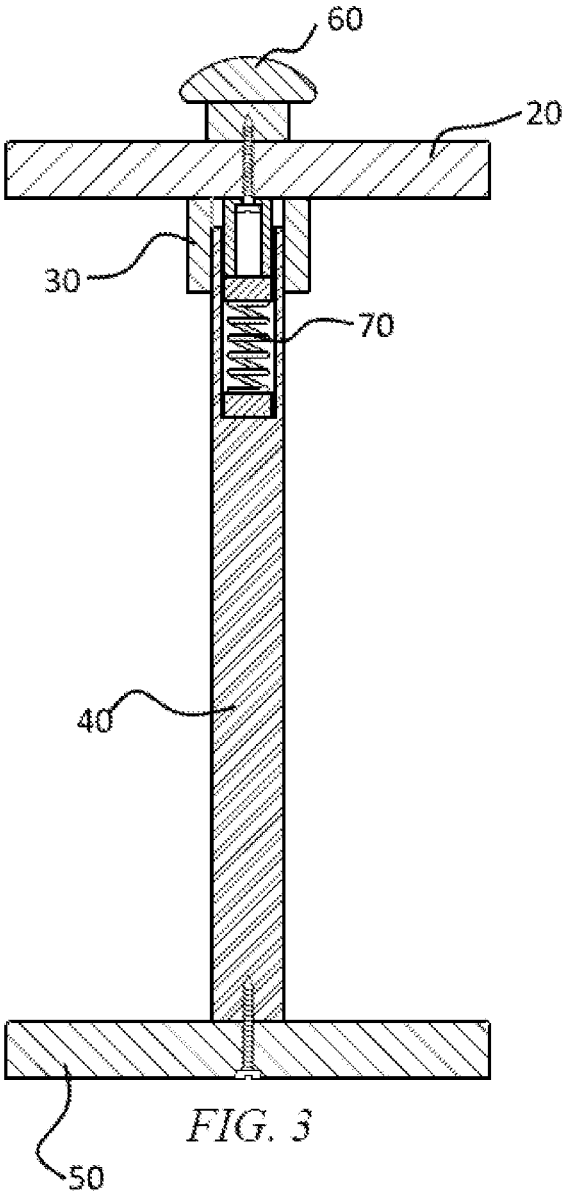
FIG. 3 is a side view of the embodiment of FIG. 1 showing the deployment mechanism inserted into the cylinder.

FIG. 3 depicts assembled device of FIG. 1. Cover 20 is shown with handle 60 attached to top surface of cover 20. Handle 60 may be fixedly attached to top surface of cover 20 by any means known in the art including, but not limited to, glue, adhesives, nails, or screws. In some embodiments, handle 60 and cover 20 are formed as one unit.

Cylinder 30 is depicted as extending distally from bottom surface of cover 20 and positioned on cover 20 such that cylinder 30 is capable of engagement with proximal end of rod 40 when in use. In this embodiment, as described in FIG. 1, cylinder 30 is hollow and has a larger diameter than the diameter of rod 40 such that cylinder 30 can telescopingly receive proximal end of rod 40 when assembled. Cylinder 30 may be formed as one piece with cover 20 or alternatively, may be formed as a separate piece that is fixedly attached to bottom surface of cover 20 by any means known in the art.

In use, proximal end of rod 40 is telescopingly inserted into hollow cylinder 30 such that braking mechanism 70 extends from cylinder 30 into proximal end of rod 40.

Braking mechanism 70 is depicted in FIG. 3 as attached to cover 20, however alternatively, braking mechanism 70 may be attached to distal end of cavity 46 of rod 40. In an embodiment, braking mechanism 70 is comprised of a biasing member capable of exerting force in a particular direction. While the figures show the biasing member of the braking mechanism 70 being a spring, the invention is not limited to this example and other biasing members for use as braking mechanism 70 are contemplated. Additionally, other braking mechanisms are contemplated which do not use biasing members. In this embodiment, one end of biasing member of braking mechanism 70 is attached to either proximal end of cylinder 30 or distal end of cavity 46 in proximal end of rod 40.

In this embodiment, cavity 46 is formed in proximal end of rod 40. Cavity 46 is sized to receive braking mechanism 70. Rod 40 is depicted as substantially solid in this embodiment, however alternatively, rod 40 may be substantially hollow. As shown in the figure, rod 40 is solid from distal end of cavity 46 to distal end of rod 40. Base 50 is attached to distal end of rod 40. In the image, a screw is used as attachment means 80 for fixedly attaching rod 40 to base 50, however any known attachment means 80 are contemplated for use with device 10 including, but not limited to, nails, adhesives, staples, screws, bolts, etc. In an alternative embodiment, rod 40 and base 50 may be formed as one continuous unit.

Figure 4:
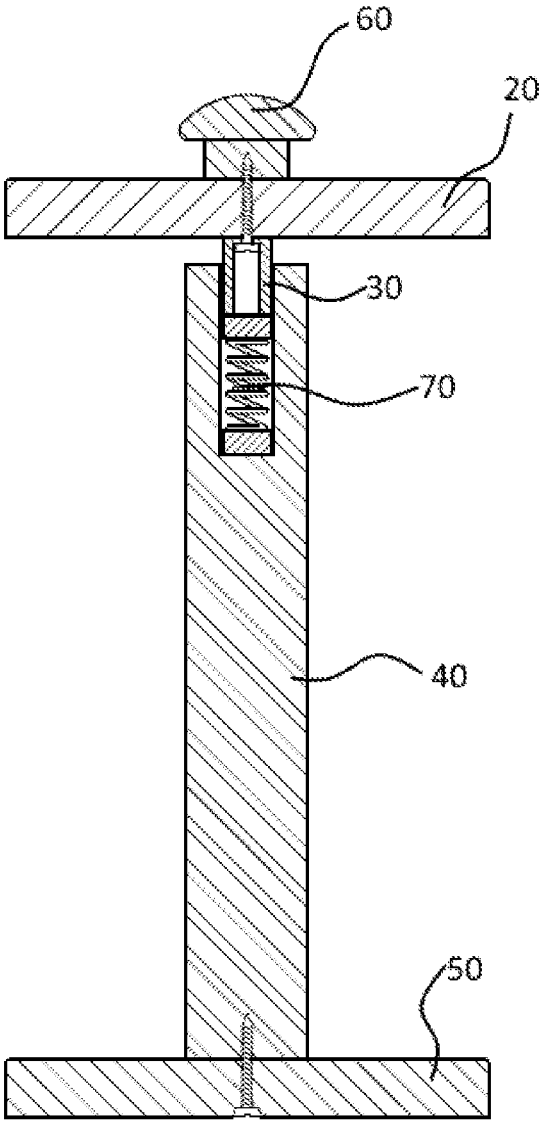
FIG. 4 is a side view of the embodiment of FIG. 2 showing the deployment mechanism inserted into the cylinder.

FIG. 4 depicts assembled device 10 of FIG. 2. Similar to FIG. 3, cover 20 is depicted with handle 60 attached to top surface of cover 20 and cylinder 30 is depicted as extending distally from bottom surface of cover 20. However, in this embodiment, cylinder 46 has a diameter that is less than the diameter of rod 40 so that cylinder 30 is telescopingly received in cavity 46 of rod 40. Cylinder 30 may be formed as one unit with cover 20 or alternatively may be formed as a separate member that is fixedly attached to bottom surface of cover 20 by any means known in the art, including, but not limited to, glues, adhesives, nails, screws, bolts, etc.

In use, distal end of cylinder 30 is telescopingly inserted into cavity 46 in proximal end of rod 40. In the figure, braking mechanism 70 extends from cylinder 30 into cavity 46 in proximal end of rod 40. Braking mechanism 70 is depicted as attached to cover 20, however alternatively, braking mechanism 70 may be attached to distal end of cavity 46 of rod 40. Rod 40 is depicted as solid in this embodiment, however alternatively, rod 40 may be substantially hollow. As shown in the figure, rod 40 is solid from distal end of cavity 46 to distal end of rod 40, with distal end of rod 40 being fixedly attached to base 50. Similar to the device depicted in FIG. 3, a screw is used as attachment means 80 for fixedly attaching rod 40 to base 50, however any known attachment means are contemplated for use with the device including, but not limited to, glues, adhesives, nails, screws, bolts, etc. In an alternative embodiment, rod 40 and base 50 may be formed as one continuous unit.

Figure 5:
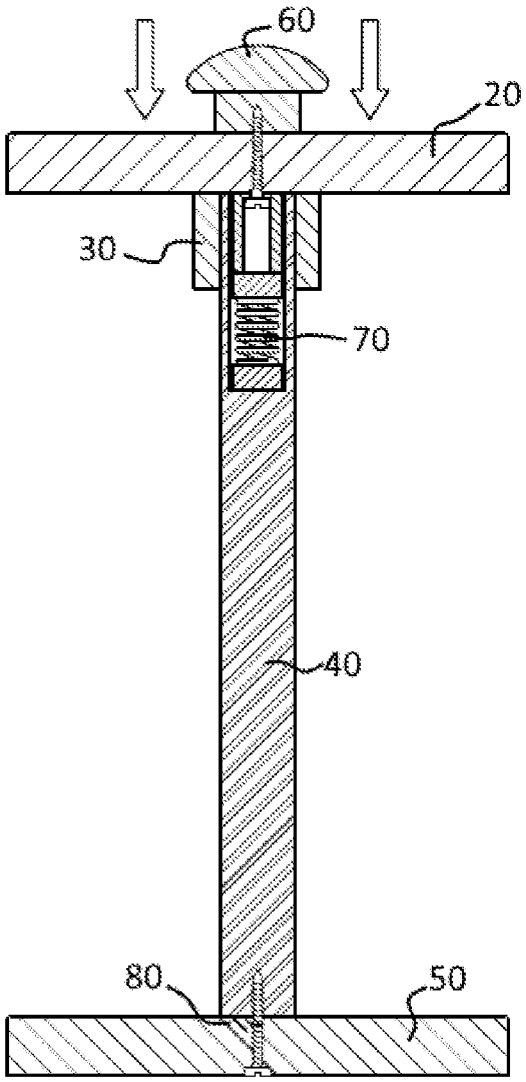
FIG. 5 is a side view of the embodiment of FIG. 3 showing the deployment mechanism inserted into the cylinder and indicating pushing down on the cover engages the deployment mechanism.

FIG. 5 depicts the device of FIGS. 1 and 3 with cover 20 depressed to engage braking mechanism 70. As shown in the image, depression of cover 20 exerts force on biasing member of braking mechanism 70 to compress biasing member and thus engage braking mechanism 70. In this embodiment, braking mechanism 70 is depicted as a spring, however any braking mechanism allowing for depression of cover 20 towards proximal end of rod 40 to exert force of a biasing member is contemplated for use. Depression of cover 20 towards rod 40 engages braking mechanism 70 moves cover 20 to engage in contact with a surface of rolled material to thus prevent movement of rolled material.

As shown in the figure, braking mechanism 70 is attached to cylinder 30. Exerting downward force on cover 20 moves cylinder 30, and consequently braking mechanism 70 towards cavity 46 of proximal end of rod 40 until braking mechanism 70 contacts distal end of cavity 46. Cavity 46 is sized such that when braking mechanism 70 comes in contact with distal end of cavity 46, cover 20 is positioned on a surface of rolled material to thus stop movement of rolled material.

Figure 6:
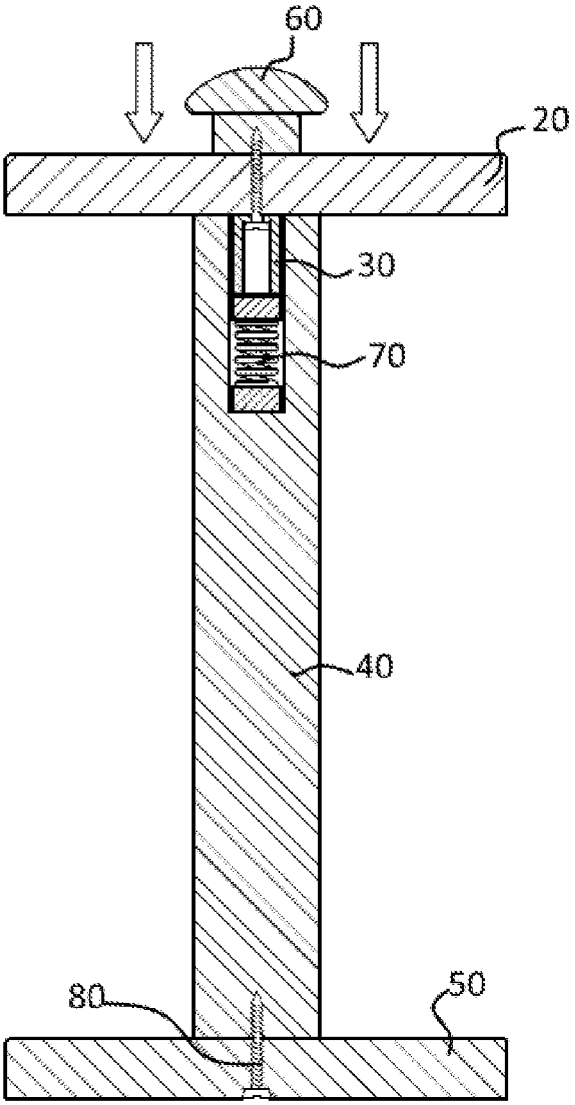
FIG. 6 is a side view of the embodiment of FIG. 4 showing the deployment mechanism inserted into the cylinder and indicating pushing down on the cover engages the deployment mechanism.

FIG. 6 depicts the device of FIGS. 2 and 4 with cover 20 depressed to engage braking mechanism 70. Braking mechanism 70 functions similar to that described above with respect to FIG. 5. As shown in the image, depression of cover 20 exerts force on biasing member of braking mechanism 70 to compress biasing member and thus engage braking mechanism 70. In this embodiment, braking mechanism 70 is depicted as a spring, however any braking mechanism allowing for depression of cover 20 towards proximal end of rod 40 to exert force of a biasing member is contemplated for use. Depression of cover 20 towards rod 40 engages braking mechanism 70 and moves cover 20 to engage in contact with a surface of rolled material to thus prevent movement of rolled material.

As shown in the figure, braking mechanism 70 is attached to cylinder 30. Exerting downward force on cover 20 moves cylinder 30, and consequently braking mechanism 70, towards cavity 46 of proximal end of rod 40 until braking mechanism 70 contacts distal end of cavity 46. Cavity 46 is sized such that when braking mechanism 70 comes in contact with distal end of cavity 46, cover 20 is positioned on a surface of rolled material to thus stop movement of rolled material. Alternatively, braking mechanism 70 may be attached to distal end of cavity 46. In this embodiment, exerting downward force on cover 20 moves cylinder 30 towards cavity 46 of proximal end of rod 40 until distal end of cylinder 30 contacts braking mechanism 70 to stop movement. Depression of cover 20 towards rod 40 engages braking mechanism 70 and moves cover 20 to engage in contact with a surface of rolled material to thus prevent movement of rolled material.

Figure 7:
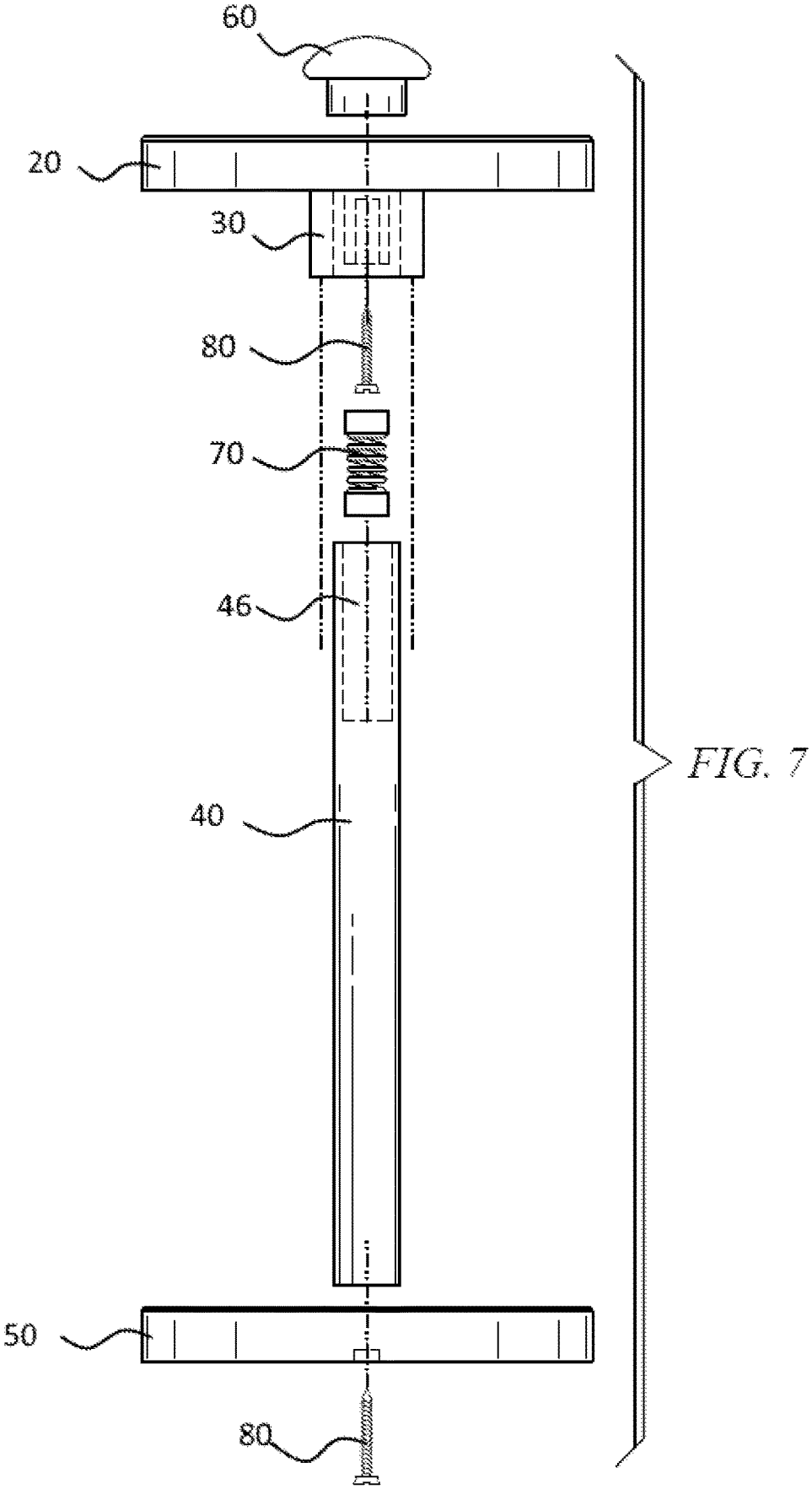
FIG. 7 is an exploded view of the embodiment of FIG. 1.

FIG. 7 depicts an exploded view of the embodiment of FIGS. 1, 3, and 5. In this embodiment, handle 60 is attached to top surface of cover 20 by attachment means 80. Braking mechanism 70 may be attached to cylinder 30 by attachment means 80 or alternatively, braking mechanism 70 may be attached to distal end of cavity 46, as described previously. Cavity 46 is shown positioned at proximal end of rod 40. Cavity 46 extends partially into rod 40 and is sized to accommodate only braking mechanism 70. Cylinder 30 is sized to accommodate proximal end of rod 40. In this figure, rod 40 is depicted as solid, with cavity 46 being the only hollow portion of rod. As discussed previously, in other embodiments, rod 40 may be substantially hollow while accommodating for cavity 46. Attachment means 80 are shown as attaching rod 40 to base 50.

Figure 8:
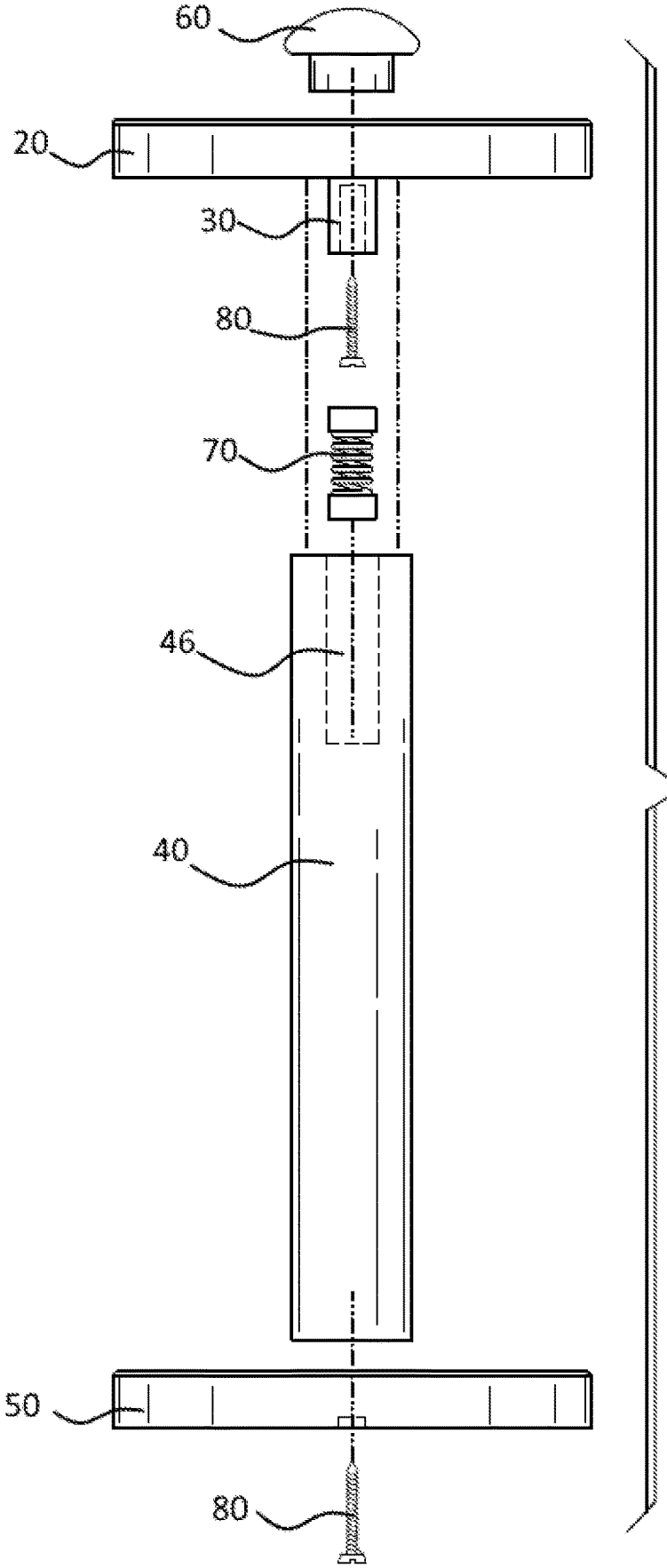
FIG. 8 is an exploded view of the embodiment of FIG. 2.

FIG. 8 depicts an exploded view of the embodiment of FIGS. 2, 4, and 6. In this embodiment, handle 60 is attached to top surface of cover 20 by attachment means 80. Braking mechanism 70 may be attached to cylinder 30 by attachment means 80 or alternatively, braking mechanism 70 is attached to distal end of cavity 46. Cavity 46 is depicted in proximal end of rod 40 with cavity 46 being sized to accommodate both braking mechanism 70 and cylinder 30. Rod 40 is depicted as solid, with cavity 46 being the only hollow portion of rod 40. As discussed previously, in other embodiments, rod 40 may be substantially hollow while accommodating for cavity 46. Attachment means 80 are shown as attaching rod 40 to base 50.

Figure 9:
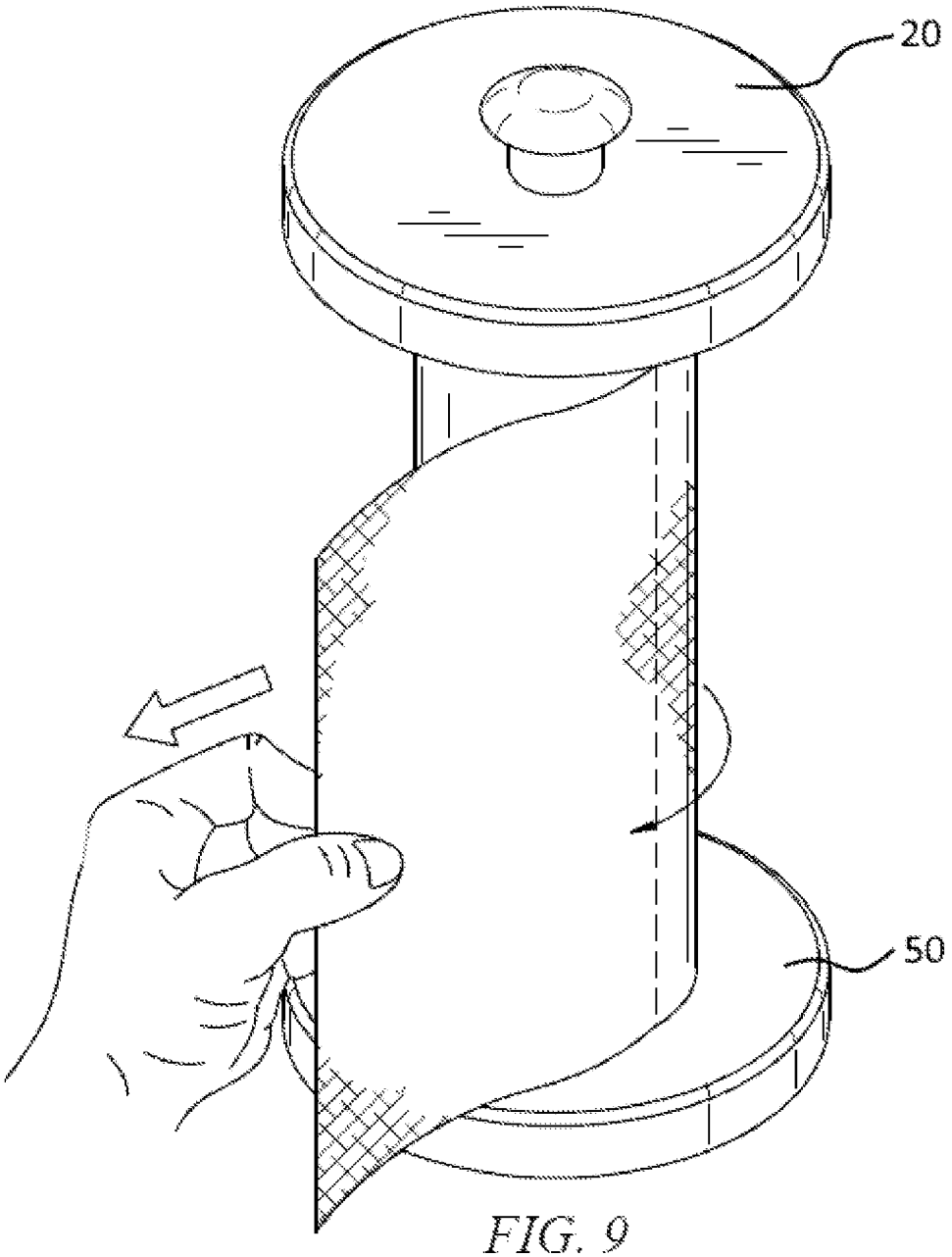
FIG. 9 is a perspective view of the device holding a paper towel roll.
Figure 10:
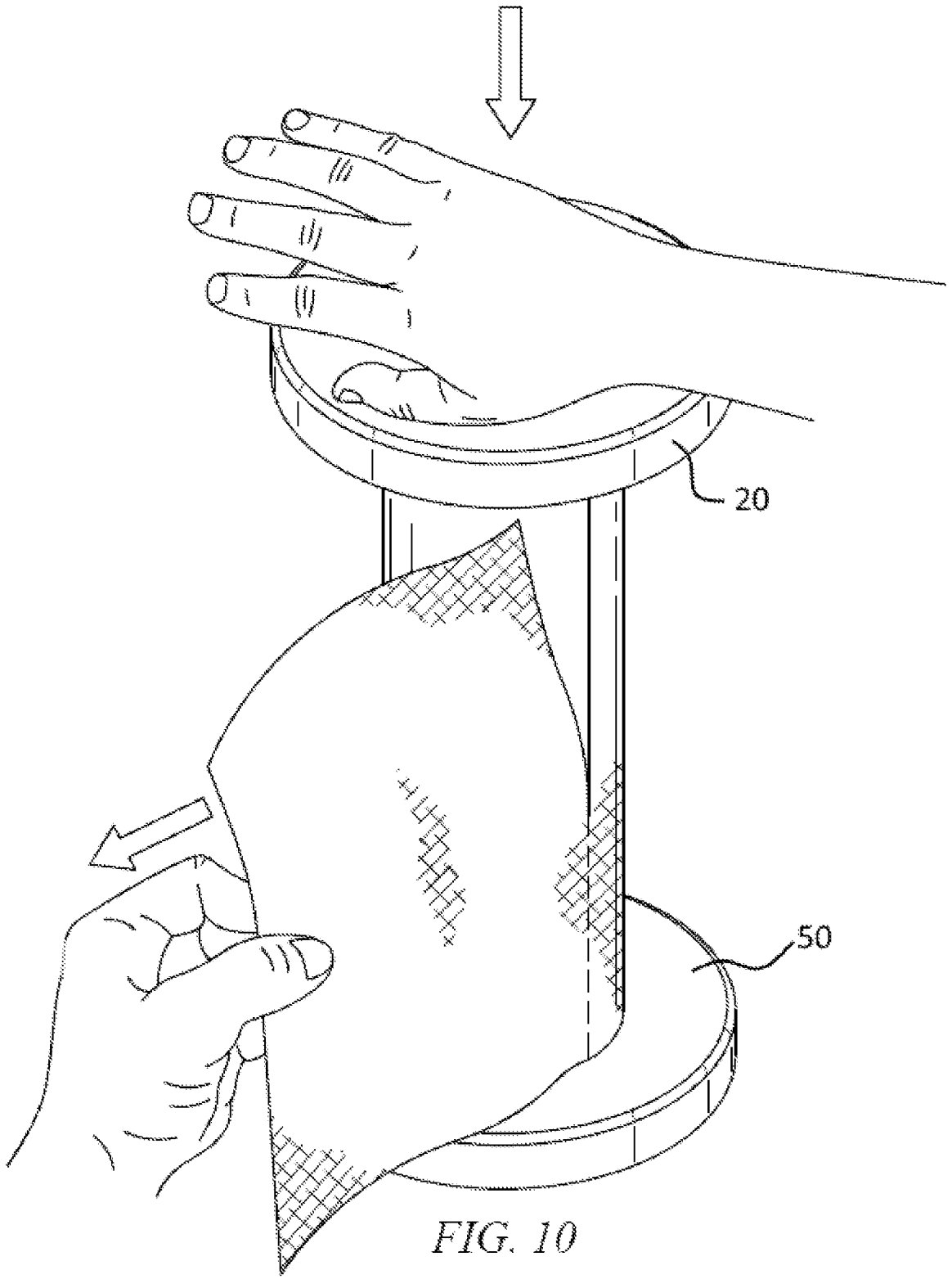
FIG. 10 is a perspective view of the device showing the cover being pushed down to engage the deployment mechanism and allow for a user-determined length of paper towel to be removed from the roll.

FIG. 9 depicts device 10 in use. When a user is dispensing an amount of rolled material, the user unwinds the material by pulling at a free end of the rolled material to unwind a desired amount of rolled material. As depicted in FIG. 10, once the desired amount of rolled material is dispensed, user depresses cover 20 towards rolled sheet material. Such depression of cover 20 engages braking mechanism 70 and allows bottom surface of cover 70 to contact rolled material thus preventing additional movement of rolled material. User may now tear the desired amount of rolled material from the remaining roll for use. Once user ceases depression of cover 20, rolled sheet material is again free to move around rod 40.

Dimensions of the dispensing device may vary according to the particular size of the rolled sheet material being dispensed. Exemplary dimensions for a paper towel dispensing device may be as follows: base about 7 inches in diameter; rod about 11 inches in length and about 1¼ inches in diameter; cavity between about 2 to 4 inches in length; braking mechanism about 2 inches in length; cover between about 5.5 to 7 inches in diameter. Such dimensions are merely exemplary and one of skill in the art would readily recognize that other dimensions are contemplated herein.

In an alternative embodiment, a telescoping rod having a locking mechanism may be used. The telescoping rod allows for changing the length of a rod to accommodate different rolled materials having differing roll heights. Telescoping rod may be comprised of two cylindrical shaped members having slightly different diameters such that one member may fit at least partially within the second member. Different locking mechanisms are contemplated for use in telescoping rod to allow for locking telescoping rod at a specific height. Exemplary locking mechanisms include, but are not limited to, a notch and tab system, a twisting notch and groove system and a ridge system. One of skill in the art would recognize different locking systems that may be used with the instant device so as to have a telescoping rod.

In an exemplary embodiment using a notch and tab system, first cylindrical member may be substantially hollow with proximal end of telescoping rod containing cavity for engagement of braking mechanism as described in previous embodiments. First cylindrical member may have a plurality of notches located at specific intervals along its longitudinal axis, such notches would not extend proximally past distal end of cavity. In some embodiments, the notches are located on opposing sides of the first cylindrical member such that the notches run parallel to each other. First cylindrical member has a slightly greater diameter than the diameter of second cylindrical member. Second cylindrical member may have parallel placed tabs at one end in which the tabs are correspondingly sized to engage with the notches in first cylindrical member. To assemble the telescoping rod, first cylindrical member received the end of second cylindrical member having the tabs is inserted into first cylindrical member and the tabs are compressed until the desired length of telescoping rod is reached at which time the tabs engage with the corresponding notches in first cylindrical member to lock telescoping rod into place. To change the length of telescoping rod, tabs are compressed and second cylindrical member is moved to the desired length of telescoping rod and tabs are engaged with the new notch position. A notch system in which grooves are present in the first cylindrical member so that the second cylindrical member is twisted into place is also contemplated.

In an exemplary embodiment using a ridge system, first cylindrical member may be substantially hollow with proximal end of telescoping rod containing cavity for engagement of braking mechanism as described in previous embodiments. First cylindrical member may have a plurality of circumferential ridges located on the inner circumferential surface at specific intervals along its longitudinal axis, such ridges would not extend proximally past distal end of cavity. First cylindrical member has a slightly greater diameter than the diameter of second cylindrical member. Proximal end of second cylindrical member may have a corresponding ridge located at its outer circumferential surface. When second cylindrical member is inserted into first cylindrical member, ridge of second cylindrical member engages with ridge of first cylindrical member to prevent movement. To change the length of telescoping rod, second cylindrical member is compressed so as to compress ridge of second cylindrical member and second cylindrical member is moved to the next desired position.

The dispensing device described herein provides a simple, safe, and easy device that allows for a desired amount of a rolled sheet material to be dispensed in a sanitary way. The rolled sheet material may be dispensed quickly and easily and may be inserted or removed from the device readily. To insert the rolled material into the device, the user removes the cover and positions the hollow tube of the rolled sheet material such that the rod is telescopingly received into the hollow tube/core of the rolled sheet material. The cover is then replaced on the device and the device is ready for use. To remove the rolled sheet material, the cover is removed from the device and the rolled sheet material is easily removed from the rod.

The disclosures of all publications cited above are expressly incorporated herein by reference, each in its entirety, to the same extent as if each were incorporated by reference individually.

It is also to be understood that the following claims are intended to cover all of the generic and specific features of the invention herein described, and all statements of the scope of the invention which, as a matter of language, might be said to fall there between. Now that the invention has been described.

What is claimed is:

1. A rolled material dispensing device comprising:

a base;

a telescoping rod comprising a telescoping structure including a first cylindrical member and a second cylindrical member slidably received therein;

a cavity formed in a proximal end of the second cylindrical member of the telescoping rod;

a cover having a top and a bottom surface and removably attached to the proximal end of the second cylindrical member of the telescoping rod;

a braking mechanism fixedly attached to the bottom surface of the cover;

wherein the braking mechanism extends into the cavity formed in the proximal end of the second cylindrical member of the telescoping rod when the cover is attached to the rod;

wherein the bottom surface of the cover includes a gripping component having a texturized surface comprising a rubberized polymer configured to engage an outer surface of the rolled material to further prevent rotation; and wherein the telescoping rod further includes a passive locking mechanism comprising a ridge system configured to adjust the telescoping rod to a predetermined length.

2. The device of claim 1, wherein the braking mechanism comprises a biasing member.

3. The device of claim 1, wherein the cover has a diameter greater than a diameter of a rolled material.

4. The device of claim 1, wherein the first cylindrical member and the second cylindrical member of the telescoping rod are substantially solid.

5. The device of claim 1, further comprising a handle fixedly attached to the top surface of the cover.

6. The device of claim 1, further comprising a hollow cylinder fixedly attached to a bottom surface of the cover.

7. The device of claim 6, wherein the braking mechanism is positioned within the cylinder.

8. The device of claim 6, wherein the hollow cylinder has a diameter greater than a diameter of the second cylindrical member of the telescoping rod.

9. The device of claim 8, wherein the diameters of the first cylindrical member and second cylindrical member of the telescoping rod are less than a diameter of a core of a rolled material enabling the telescoping rod to be inserted into the core of the rolled material for dispensing.

10. A rolled material dispensing device comprising:

a base;

a telescoping rod comprising a telescoping structure including a first cylindrical member and a second cylindrical member slidably received therein;

a cavity formed in the proximal end of the second cylindrical member of the telescoping rod;

a cover having a top and a bottom surface and removably attached to the proximal end of the second cylindrical member of the telescoping rod;

a solid cylinder extending distally from the bottom surface of the cover;

a braking mechanism fixedly attached to a distal end of the cylinder;

wherein the braking mechanism and the cylinder extend into the cavity formed in the proximal end of the second cylindrical member of the telescoping rod when the cover is attached to the rod;

wherein the bottom surface of the cover includes a gripping component having a texturized surface comprising a rubberized polymer configured to engage an outer surface of the rolled material to further prevent rotation; and wherein the telescoping rod further includes a passive locking mechanism comprising a notch and tab system configured to adjust the telescoping rod to a predetermined length.

11. The device of claim 10, further comprising a handle fixedly attached to the top surface of the cover.

12. The device of claim 10, wherein the braking mechanism comprises a biasing member.

13. The device of claim 10, wherein the cover has a diameter greater than a diameter of a rolled material.

14. The device of claim 10, wherein the diameters of the first cylindrical member and second cylindrical member of the telescoping rod are less than a diameter of a core of a rolled material enabling the telescoping rod to be inserted into the core of the rolled material for dispensing.

15. The device of claim 10, wherein the first cylindrical member and the second cylindrical member of the telescoping rod are substantially solid.

16. A method of dispensing rolled material comprising:

providing a rolled material dispensing device comprising:

a base;

a telescoping rod comprising a telescoping structure including a first cylindrical member and a second cylindrical member slidably received therein;

a cavity formed in the proximal end of the second cylindrical member of the telescoping rod;

a cover having a top and a bottom surface and removably attached to the proximal end of the second cylindrical member of the telescoping rod;

a solid cylinder extending distally from the bottom surface of the cover; and a braking mechanism fixedly attached to a distal end of the cylinder;

wherein the braking mechanism and the cylinder extend into the cavity formed in the proximal end of the second cylindrical member of the telescoping rod when the cover is attached to the rod;

wherein the bottom surface of the cover includes a gripping component having a texturized surface comprising a rubberized polymer configured to engage an outer surface of the rolled material to further prevent rotation; and wherein the telescoping rod further includes a passive locking mechanism comprising a notch and tab system configured to adjust the telescoping rod to a predetermined length;

pulling the rolled material to dispense a desired amount;

exerting a downward force on the cover until the bottom surface of the cover engages with a surface of the rolled material to stop movement of the rolled material;

removing the desired amount of the rolled material;

removing the downward force from the cover to allow the cover to disengage with the surface of the rolled material.

17. The method of claim 16, wherein the rolled material dispensing device further comprises a handle fixedly attached to the top surface of the cover.

18. The method of claim 16, wherein the braking mechanism comprises a biasing member.

19. The method of claim 16, wherein the cover has a diameter greater than a diameter of a rolled material.

20. The method of claim 16, wherein the diameters of the first cylindrical member and second cylindrical member of the telescoping rod are less than a diameter of a core of a rolled material enabling the telescoping rod to be inserted into the core of the rolled material for dispensing.

* * * * *